US009336786B2

(12) United States Patent
Asada et al.

(10) Patent No.: US 9,336,786 B2
(45) Date of Patent: May 10, 2016

(54) SIGNAL PROCESSING DEVICE, SIGNAL PROCESSING METHOD, AND STORAGE MEDIUM

(71) Applicant: Sony Corporation, Minato-ku (JP)

(72) Inventors: Kohei Asada, Kanagawa (JP); Yoichiro Sako, Tokyo (JP); Kazuyuki Sakoda, Chiba (JP); Mitsuru Takehara, Tokyo (JP); Takatoshi Nakamura, Tokyo (JP); Akira Tange, Tokyo (JP); Hiroyuki Hanaya, Kanagawa (JP); Yuki Koga, Tokyo (JP); Tomoya Onuma, Shizuoka (JP)

(73) Assignee: SONY CORPORATION, Tokyo (JP)

( * ) Notice: Subject to any disclaimer, the term of this patent is extended or adjusted under 35 U.S.C. 154(b) by 68 days.

(21) Appl. No.: 14/154,357

(22) Filed: Jan. 14, 2014

(65) Prior Publication Data

US 2014/0257802 A1 Sep. 11, 2014

(30) Foreign Application Priority Data

Mar. 7, 2013 (JP) ..... 2013-045230

(51) Int. Cl.

| | |
|---|---|
| ***G10L 19/12*** | (2013.01) |
| ***G10L 19/012*** | (2013.01) |
| ***G10L 21/06*** | (2013.01) |
| ***G10K 11/175*** | (2006.01) |
| *H04K 3/00* | (2006.01) |

(52) U.S. Cl.

CPC ..... *G10L 19/012* (2013.01); *G10K 11/175* (2013.01); *G10L 21/06* (2013.01); *H04K 3/46* (2013.01); *H04K 3/825* (2013.01); *H04K 3/28* (2013.01); *H04K 3/45* (2013.01); *H04K 2203/12* (2013.01)

(58) Field of Classification Search

CPC ... H04K 2203/12; H04K 1/02; H04M 1/6041; H04M 9/08; H04M 1/68; H04R 3/005; H04R 3/12; H04B 15/00

USPC ..... 704/226, 270.1, 235, 278, 200, 273; 380/252, 253; 455/575.1, 156.1, 159.1, 455/569.1, 569.2, 575.9, 90.3; 381/71.6

See application file for complete search history.

(56) References Cited

U.S. PATENT DOCUMENTS

| | | | | |
|---|---|---|---|---|
| 7,016,844 | B2 * | 3/2006 | Othmer et al. | 704/270.1 |
| 7,599,719 | B2 * | 10/2009 | Patton | 455/575.1 |
| 2006/0109983 | A1 * | 5/2006 | Young et al. | 380/252 |
| 2009/0074199 | A1 * | 3/2009 | Kierstein et al. | 381/71.6 |

FOREIGN PATENT DOCUMENTS

| | | |
|---|---|---|
| JP | 2012-119785 | 6/2012 |

* cited by examiner

*Primary Examiner* — Charlotte M Baker
(74) *Attorney, Agent, or Firm* — Hazuki International, LLC

(57) ABSTRACT

There is provided a signal processing device including a voice pickup unit that picks up a user's voice and generates an audio signal, a signal processing unit that generates a masking voice signal for masking the user's voice according to the audio signal, and a first speaker that reproduces the masking voice signal.

16 Claims, 13 Drawing Sheets

SIGNAL PROCESSING DEVICE, SIGNAL PROCESSING METHOD, AND STORAGE MEDIUM

CROSS REFERENCE TO RELATED APPLICATIONS

This application claims the benefit of Japanese Priority Patent Application JP 2013-045230 filed Mar. 7, 2013, the entire contents of which are incorporated herein by reference.

BACKGROUND

The present disclosure relates to a signal processing device, a signal processing method, and a storage medium.

In recent years, chances for users to speak through telephone calls have increased as portable terminals such as smartphones or tablet terminals have come into wide use. Also, chances for users to speak have further increased as void recognition functions of controlling portable terminals based on the content of a user's utterance have come into wide use. Many noise reduction technologies for suppressing extraneous noise from picked-up voices of users have been suggested in view of the increase in the chances for users to speak and use of portable terminals under noise environments.

On the other hand, portable terminals are often used in situations in which other people nearby can hear, and thus there is a high probability of users' voices being heard by other people nearby. In some cases, users may be reluctant for other people to hear the content of their utterances or may consider inhibiting other people from hearing the content of their utterances from the viewpoint of security. Accordingly, masking technologies for hindering other people nearby from hearing the utterance content have been necessary.

For example, JP 2012-119785A discloses a technology for hindering other people nearby from hearing the utterance content of a user by downloading a masking voice signal from a server and reproducing the masking voice signal in order to use a masking technology in a portable terminal.

SUMMARY

In JP 2012-119785A described above, however, since a dedicated device is necessary to generate the masking voice signal, the masking technology may not be used only with a portable terminal.

It is desirable to provide a novel and improved signal processing device, a novel and improved signal processing method, and a novel and improved storage medium capable of generating and reproducing a masking voice signal according to a user's voice.

According to an embodiment of the present disclosure, there is provided a signal processing device including a voice pickup unit that picks up a user's voice and generates an audio signal, a signal processing unit that generates a masking voice signal for masking the user's voice according to the audio signal, and a first speaker that reproduces the masking voice signal.

According to an embodiment of the present disclosure, there is provided a signal processing method including picking up a user's voice and generating an audio signal, generating a masking voice signal for masking the user's voice according to the audio signal, and reproducing the masking voice signal.

According to an embodiment of the present disclosure, there is provided a non-transitory computer-readable storage medium having a program stored therein, the program causing a computer to execute picking up a user's voice and generating an audio signal, generating a masking voice signal for masking the user's voice according to the audio signal, and reproducing the masking voice signal.

As described above, according to embodiments of the present disclosure, it is possible to generate and reproduce a masking voice signal according to a user's voice.

DETAILED DESCRIPTION OF THE EMBODIMENTS

Figure 1:
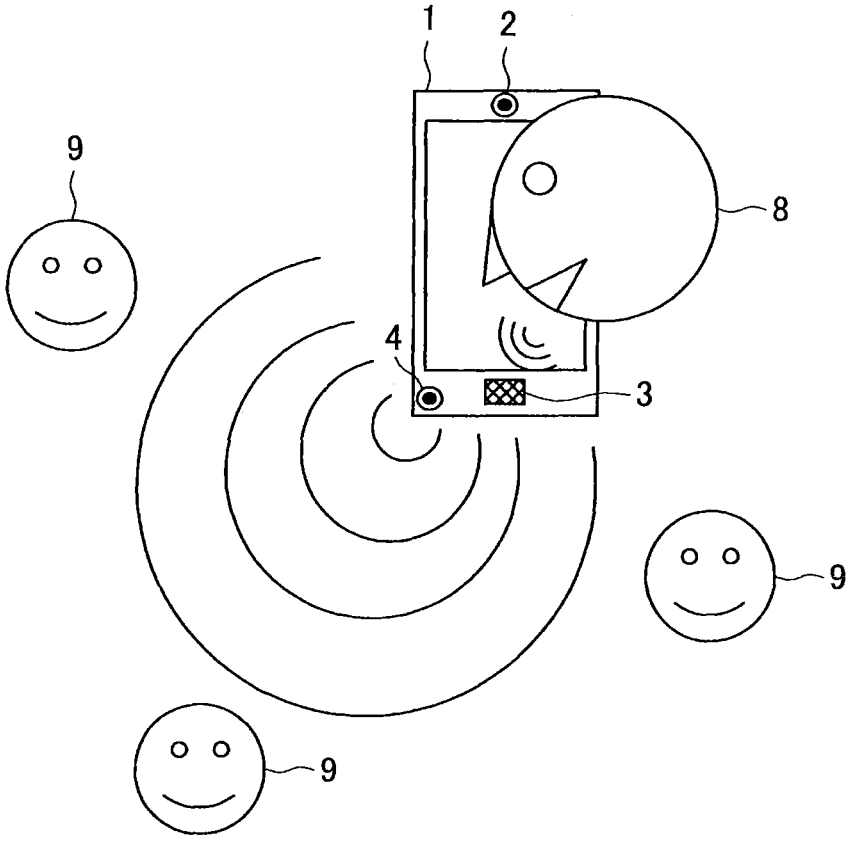
FIG. 1 is an explanatory diagram illustrating an introduction of a signal processing device according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

1. Introduction of signal processing device according to embodiment of the present disclosure
2. Embodiments
2-1. First embodiment
(2-1-1. Configuration of smartphone)
(2-1-2. Operation process)
(2-1-3. First modification example)
2-2. Second embodiment
2-3. Third embodiment
(2-3-1. Basic form)
(2-3-2. Second modification example)
(2-3-3. Third modification example)

3. Conclusion

<<1. Introduction of Signal Processing Device According to Embodiment of the Present Disclosure>>

An introduction of a signal processing device according to an embodiment of the present disclosure will be described with reference to FIG. 1. FIG. 1 is an explanatory diagram illustrating the introduction of the signal processing device according to an embodiment of the present disclosure. As illustrated in FIG. 1, the signal processing device according to the embodiment is realized by, for example, a smartphone 1.

The smartphone 1 includes a telephone speaker 2, a microphone 3 (hereinafter referred to as a mic 3), and a masking speaker 4. A user 8 telephones with the telephone speaker 2 and the mic 3 or controls the smartphone 1 by voice recognition by uttering control information through the mic 3.

Figure 2:
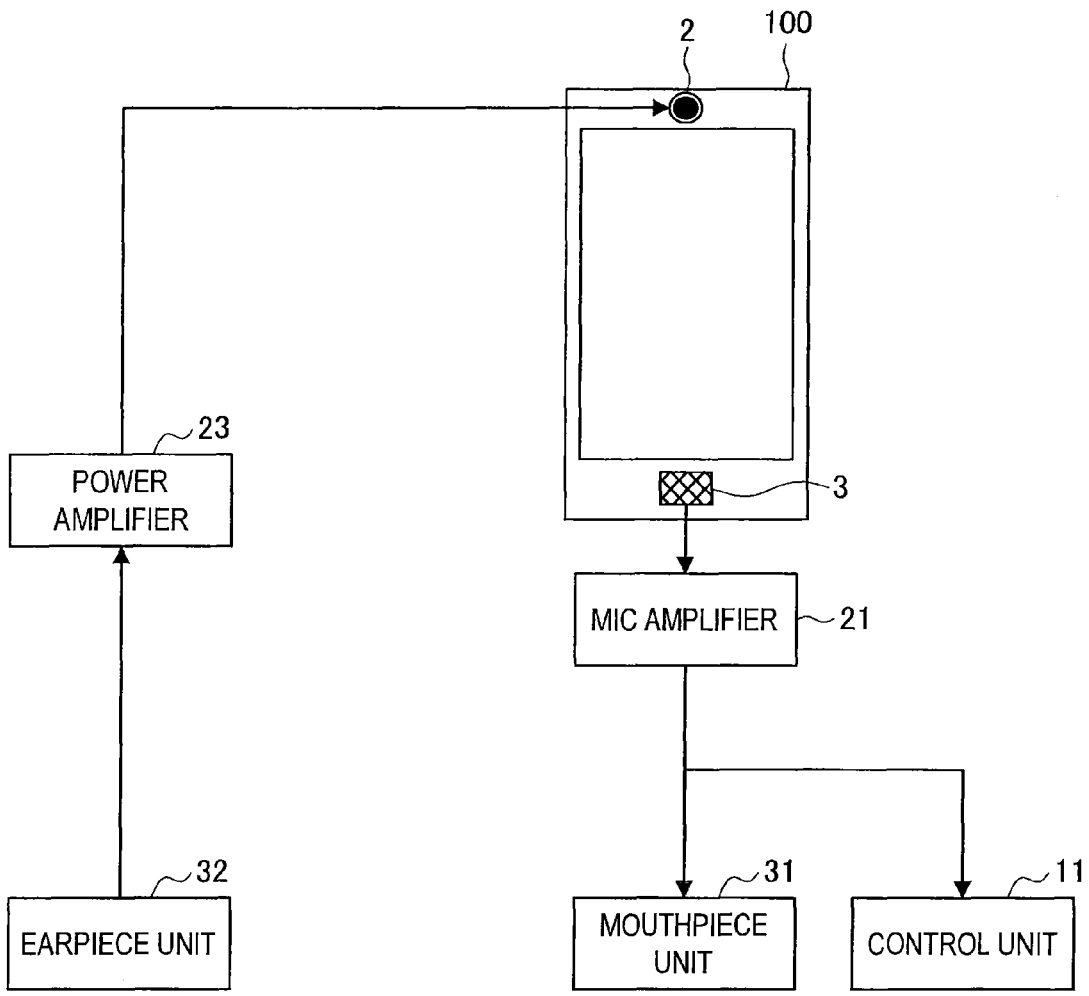
FIG. 2 is a block diagram illustrating the configuration of a smartphone according to a comparative example.

Here, a general configuration of a smartphone according to a comparative example will be described with reference to FIG. 2. FIG. 2 is a block diagram illustrating the configuration of a smartphone 100 according to a comparative example. Each block illustrated in FIG. 2 is included inside the smartphone 100. As illustrated in FIG. 2, the smartphone 100 includes a telephone speaker 2, a mic 3, a control unit 11, a mic amplifier 21, a power amplifier 23, a mouthpiece unit 31, and an earpiece unit 32. When the user 8 telephones with the smartphone 100, the voice of a telephone partner received by the earpiece unit 32 is amplified by the power amplifier 23 and is reproduced by the telephone speaker 2. The voice uttered by the user 8 is picked up by the mic 3, is amplified by the mic amplifier 21, and is transmitted to the terminal of the telephone call partner by the mouthpiece unit 31. Also, the control unit 11 controls the smartphone 100 by performing voice recognition of the voice uttered by the user 8.

The voice uttered through the smartphone 100 by the user 8 can be heard by other people nearby. However, in some cases, the user 8 may be reluctant for other people to hear the utterance content or may consider inhibiting other people form hearing the utterance content from the viewpoint of security. However, this may be difficult since the smartphone 100 according to the comparative example is not configured such that the voice uttered by the user 8 is not heard by other people.

Accordingly, a signal processing device according to an embodiment of the present disclosure has been finalized in light of the above-mentioned circumstance. The signal processing device according to an embodiment of the present disclosure can prevent other people nearby from hearing the voice uttered by the user 8 by reproducing a masking voice signal. Since the smartphone 1 according to the embodiment includes the masking speaker 4, as illustrated in FIG. 1 and reproduces a masking voice signal from the masking speaker 4, other people 9 nearby are hindered from hearing the utterance content of the user 8.

However, the masking speaker 4 reproduces simple noise such as white noise as the masking voice signal, and there is a probability of the other people 9 easily distinguishing the voice uttered by the user 8 from the masking voice signal and hearing the utterance content of the user 8. Accordingly, the smartphone 1 according to the embodiment picks up a voice uttered by the user 8 through the mic 3 and generates and reproduces a masking voice signal according to the picked-up user's voice so that the other people are hindered from hearing the utterance content.

The introduction of the signal processing device according to an embodiment of the present disclosure has been described above. Next, a signal processing device according to an embodiment of the present disclosure will be described in detail.

In the example illustrated in FIG. 1, the smartphone 1 has been used as an example of the signal processing device, but an information processing device according to an embodiment of the present disclosure is not limited thereto. For example, the signal processing device may be a head-mounted display (HMD), a head set, a digital camera, a digital video camera, a personal digital assistant (PDA), a personal computer (PC), a note-type PC, a tablet terminal, a portable telephone terminal, a portable music reproduction device, a portable video processing device, or a portable game device.

<<2. Embodiments>>

<2-1. First Embodiment>

2-1-1. Configuration of Smartphone

Figure 3:
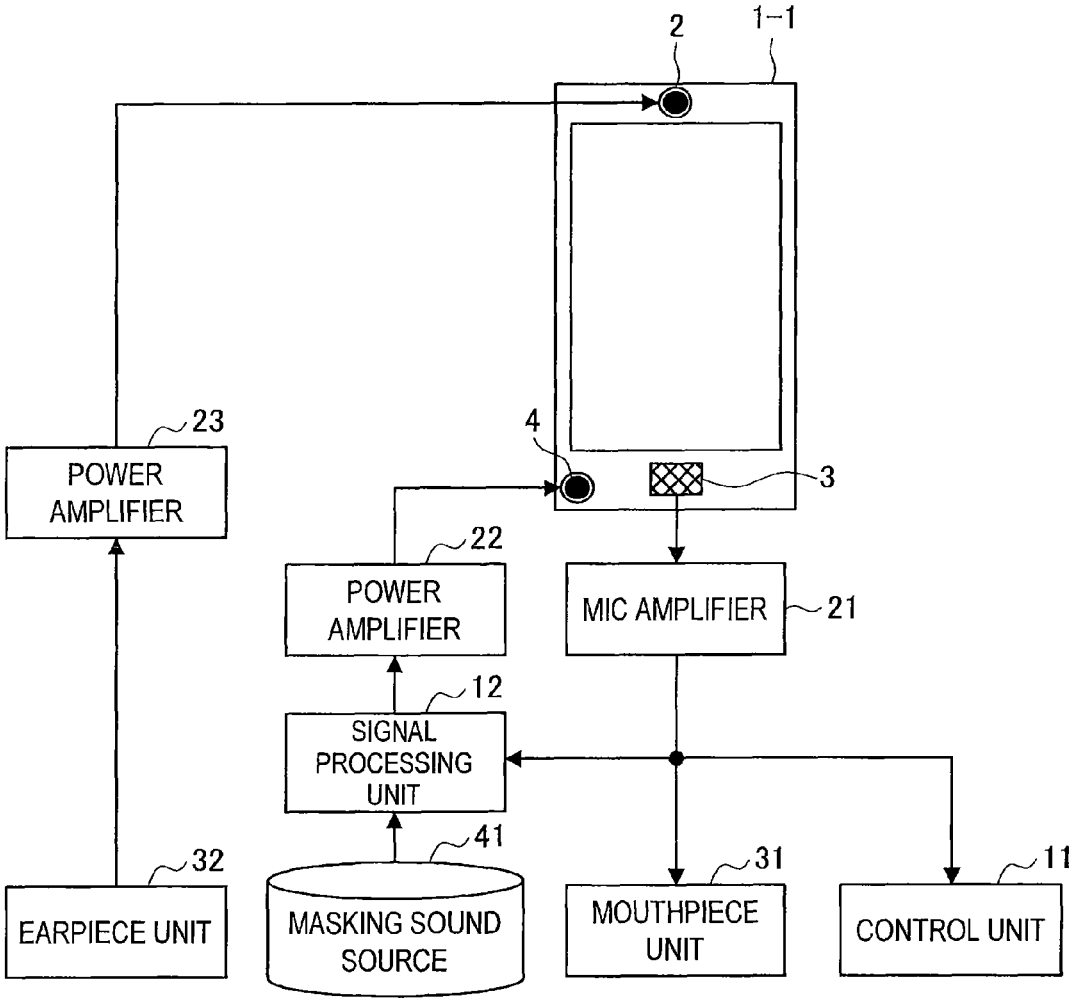
FIG. 3 is a block diagram illustrating the configuration of a smartphone according to a first embodiment.

First, the configuration of a smartphone 1-1 according to an embodiment will be described with reference to FIG. 3. FIG. 3 is a block diagram illustrating the configuration of the smartphone 1-1 according to a first embodiment. Each block illustrated in FIG. 3 is included in the smartphone 1-1. As illustrated in FIG. 3, the smartphone 1-1 includes a telephone speaker 2, a mic 3, a masking speaker 4, a control unit 11, a signal processing unit 12, a mic amplifier 21, a power amplifier 22, a power amplifier 23, a mouthpiece unit 31, an earpiece unit 32, and a masking sound source 41. Hereinafter, each constituent element of the smartphone 1-1 will be described in detail.

(Earpiece Unit 32)

The earpiece unit 32 has a function of a communication unit receiving an audio signal from the outside. Specifically, the earpiece unit 32 receives an audio signal indicating a voice of a telephone partner from a terminal of the telephone call partner. The earpiece unit 32 outputs the received audio signal to the power amplifier 23.

(Power Amplifier 23)

The power amplifier 23 has a function of amplifying the audio signal output from the earpiece unit 32. The power amplifier 23 outputs the amplified audio signal to the telephone speaker 2.

(Telephone Speaker 2)

The telephone speaker 2 is an output device that reproduces the audio signal output from the power amplifier 23. In the embodiment, the user 8 is assumed to use the smartphone 1-1 holding the telephone speaker 2 to his or her ear.

(Mic 3)

The mic 3 has a function of a voice pickup unit picking up a user's voice and generating an audio signal. More specifically, the mic 3 picks up a voice uttered by the user 8 and generates an audio signal. At this time, the mic 3 can also pick up a masking voice signal generated by the masking speaker 4 to be described below along with the voice of the user 8 and generate an audio signal. That is, the audio signal generated by the mic 3 can include the user's voice and a masking voice signal. Hereinafter, the audio signal generated by the mic 3 is also referred to as a voice pickup signal. The mic 3 outputs the generated voice pickup signal to the mic amplifier 21.

(Mic Amplifier 21)

The mic amplifier 21 has a function of amplifying the voice pickup signal output from the mic 3. The mic amplifier 21 outputs the amplified voice pickup signal to the control unit 11, the mouthpiece unit 31, and the signal processing unit 12.

(Control Unit 11)

The control unit 11 functions as an arithmetic processing device and a control device and controls general operations of the smartphone 1-1 according to various programs. The control unit 11 is realized by, for example, a central processing unit (CPU) or a microprocessor. Also, the control unit 11 may include a read-only memory (ROM) that stores a program and an arithmetic parameter or the like to be used and a random access memory (RAM) that temporarily stores an appropriately changed parameter or the like.

The control unit 11 has a function of a control information recognition unit that recognizes control information from a user's voice included in the voice pickup signal. More specifically, the control unit 11 recognizes the control information included in the user's voice from the voice pickup signal output from the mic amplifier 21. For example, the control unit 11 recognizes control information for phoning, transmission of a message, retrieval, or the like based on the utterance content of the user. The control unit 11 has a function of controlling the smartphone 1-1 based on the recognized control information. For example, the control unit 11 controls the smartphone 1-1 based on the control information for phoning, transmission of a message, retrieval, or the like and actually performs the phoning, the transmission of a message, the retrieval, or the like. Also, the control unit 11 has a function of a language recognition unit recognizing a language of a user's voice picked up by the mic 3. For example, the control unit 11 recognizes that the language spoken by the user 8 is Japanese, English, Chinese, or the like. Also, the control unit 11 may recognize a native language or a native place of the user 8 according to the pronunciation, intonation, or the like of the user 8.

(Mouthpiece Unit 31)

The mouthpiece unit 31 has a function of a communication unit transmitting the voice pickup signal to the outside. More specifically, the mouthpiece unit 31 transmits the voice pickup signal output from the mic amplifier 21 to the terminal of the telephone call partner.

(Power Amplifier 22)

The power amplifier 22 has a function of amplifying the masking voice signal output from the signal processing unit 12 to be described below. The power amplifier 22 outputs the amplified voice pickup signal to the masking speaker 4. Also, the power amplifier 22 amplifies the volume such that the other people 9 nearby may hear the making voice signal reproduced by the masking speaker 4 and the other people 9 nearby may not hear the utterance content of the user 8.

(Masking Speaker 4)

The masking speaker 4 is an output device (first speaker) that reproduces the masking voice signal. More specifically, the masking speaker 4 reproduces the masking voice signal output from the power amplifier 22.

(Masking Sound Source 41)

The masking sound source 41 has a function of a recording unit recording a sound source which is the origin for generating the masking voice signal. For example, the masking sound source 41 records, as sound sources, various kinds of noise such as band noise of a voice band of 300 Hz to 3 kHz, a voice signal of a meaningless string, voice sounds of a plurality of people including men and women, white noise, and colored noise. Further, the masking sound source 41 may record the user's voices picked up by the mic 3 as the sound sources. The signal processing unit 12 to be described below generates a masking voice signal based on the sound sources recorded in the masking sound source 41.

(Signal Processing Unit 12)

The signal processing unit 12 generates a masking voice signal for masking a user's voice according to the voice pickup signal. More specifically, the signal processing unit 12 generates a masking voice signal using the sound sources recorded in the masking sound source 41 based on the voice pickup signal output from the mic amplifier 21. Here, masking of the user's voice means that the utterance of the user 8 is embedded into the masking voice signal reproduced by the masking speaker 4 and is thus concealed so that the other people 9 may not hear. Various kinds of masking voice signals for masking a user's voice can be considered.

For example, the signal processing unit 12 generates a masking voice signal generally using band noise of a voice band of 300 Hz to 3 kHz, a voice signal of a meaningless string, or voice sounds of a plurality of people including men and women. In this case, since the masking voice signal indicates noise or a voice with the same band as the voice of the user 8, the other people 9 may mistake the masking voice signal for the utterance of the user 8, and thus the utterance of the user 8 can be masked. Also, the signal processing unit 12 may generate a masking voice signal based on the voice of the user 8 himself or herself recorded by the masking sound source 41. Since the masking voice signal based on the past voice of the user 8 himself or herself is more easily mistaken for the voice currently uttered by the user 8, the utterance of the user 8 can be masked more strongly.

Further, the signal processing unit 12 may generate a masking voice signal with content meaningful for the other people 9. When the masking voice signal has content meaningful for the other people 9, the masking voice signal averts the attention of the other people 9 from the utterance content of the user 8, and thus the utterance of the user 8 can be masked.

For example, the signal processing unit 12 may generate a masking voice signal according to a language of the user 8 recognized by the control unit 11. Specifically, the signal processing unit 12 may generate a masking voice signal based on a language which is the same as or different from the language used by the user 8. At this time, when the language of the masking voice signal is the same as the language used by the other people 9, the other people 9 can understand the content indicated by the masking voice signal, and thus the attention of the other people 9 is drawn to the masking voice signal. On the other hand, when the language of the masking voice signal is different from the language used by the other people 9, the other people 9 are interested in a rare foreign language or dialect, and thus the attention of the other people 9 is likewise drawn to the masking voice signal. Since such a masking voice signal averts the attention of the other people 9 from the utterance content of the user 8, the masking voice signal hinders the other people 9 from hearing the utterance of the user 8. Also, the signal processing unit 12 may estimate a language used by the nearby other people 9 by assuming that the user 8 is in the homeland or native place based on the native language, the native place, or the like of the user 8 recognized by the control unit 11 and may generate a masking voice signal according to the language of the nearby people 9. Also, when the language of the masking voice signal is the same as the language used by the user 8, the masking voice signal has the same frequency band as the utterance of the user 8, and thus can also cause the other people 9 to be confused about the utterance of the user 8. Further, examples of the conceivable masking voice signal which is meaningful for and attracts the other people 9 include signals generated based on talking voices of famous people or notable people.

The smartphone 1-1 may mask the utterance of the user 8 by causing the volume of the produced masking voice signal to be greater than the utterance of the user 8.

Further, the signal processing unit 12 may generate a masking voice signal only in a time section in which a user's voice is included in the voice pickup signal. In this case, since the masking voice signal is not uniformly reproduced, the other people 9 are prevented from becoming familiar with the masking voice signal. Also, since the masking voice signal is reproduced simultaneously with the utterance of the user 8, the other people 9 can be caused to rarely identify the utterance of the user 8 with the masking voice signal. Hereinafter, the description will be made with reference to FIGS. 4A and 4B by contrasting an example in which a masking voice signal is continuously generated with an example in which a masking voice signal is generated only in a time section in which a user's voice is included in a voice pickup signal.

Figure 4A:
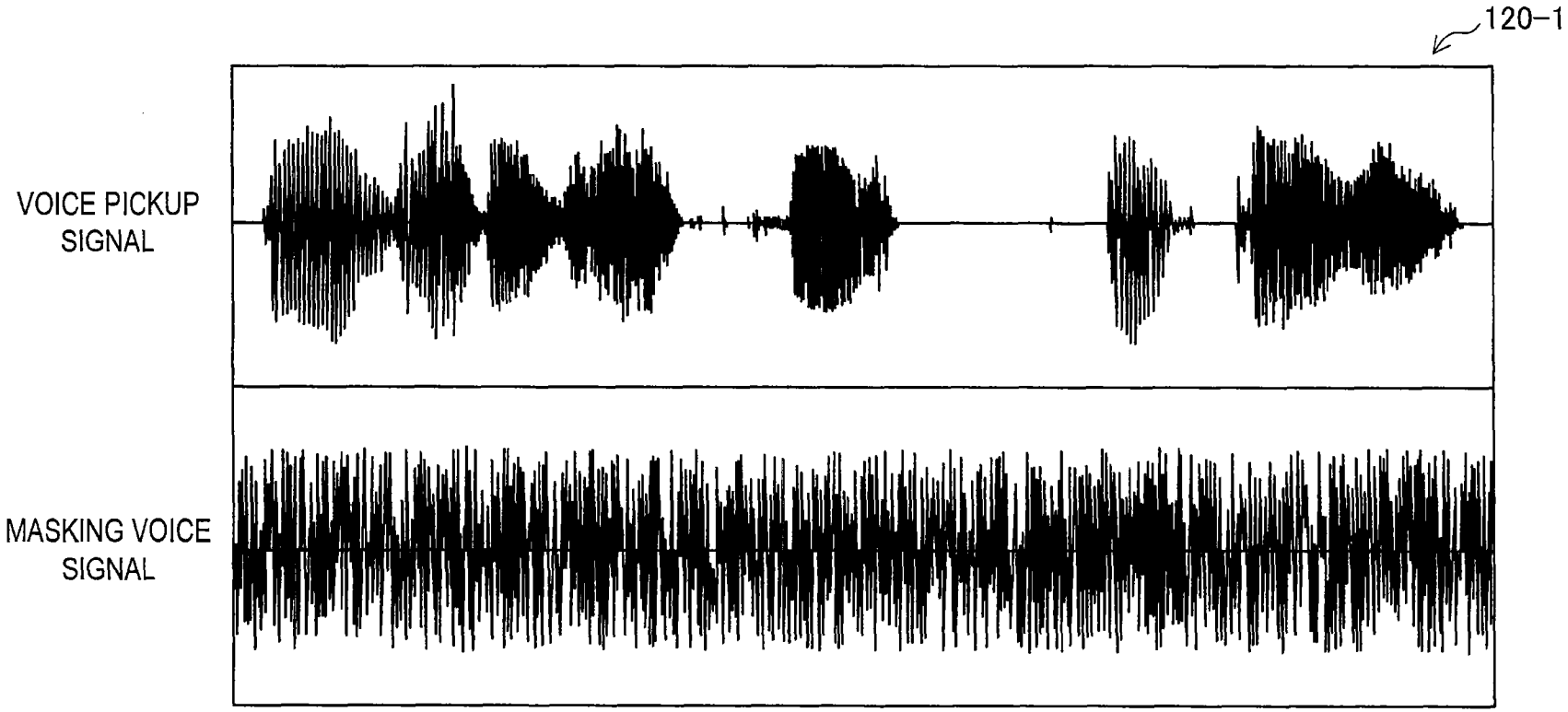
FIG. 4A is an explanatory diagram illustrating an example of a masking voice signal generated by a signal processing unit according to the first embodiment.
Figure 4B:
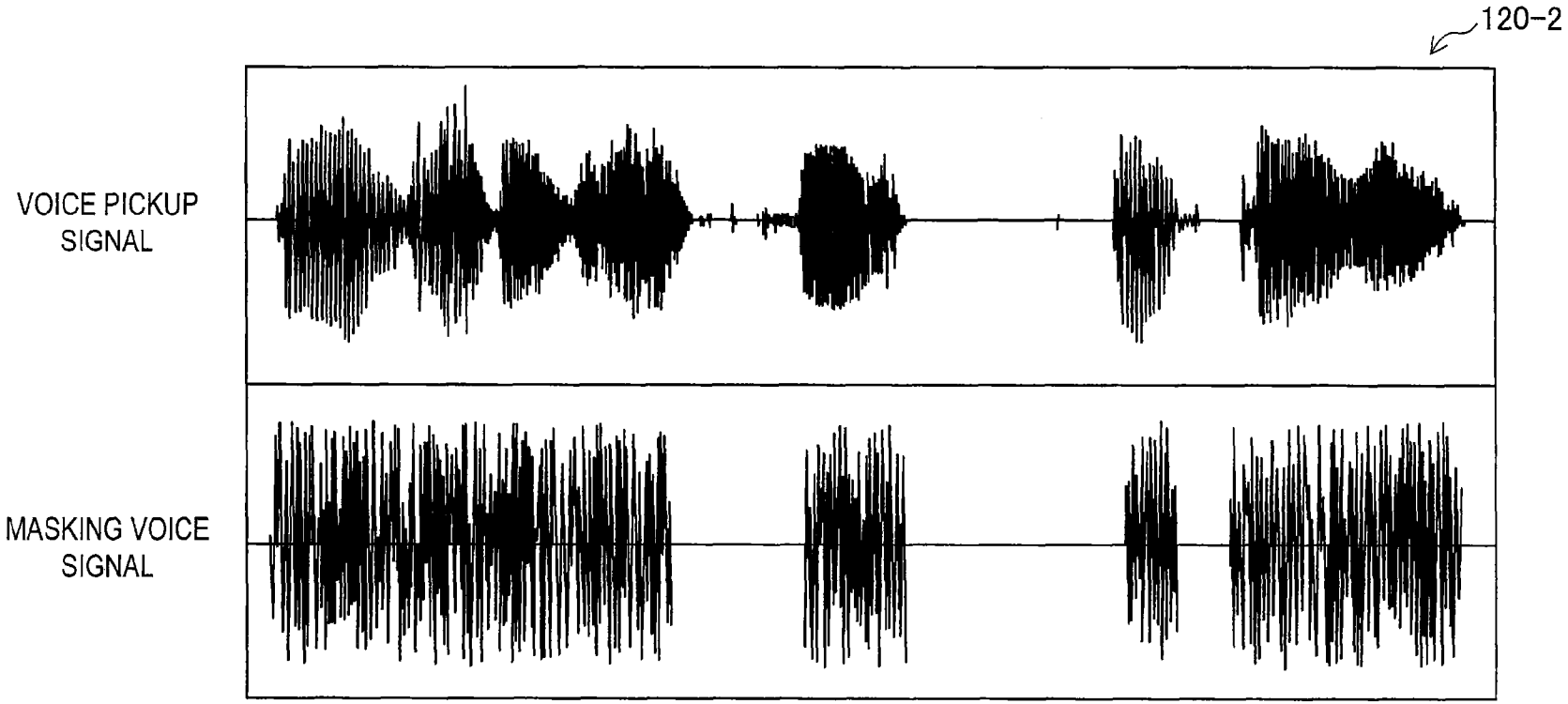
FIG. 4B is an explanatory diagram illustrating an example of a masking voice signal generated by the signal processing unit according to the first embodiment.

FIGS. 4A and 4B are explanatory diagrams illustrating examples of a masking voice signal generated by the signal processing unit 12 according to the first embodiment. FIGS. 4A and 4B show voice signal examples 120-1 and 120-2 indicating the voice pickup signal and the masking voice signal from a switch time of the smartphone 1-1 to an operation mode in which a telephone call or voice recognition is performed to the end of the operation mode.

The voice signal example 120-1 represents a waveform when the signal processing unit 12 generates a continuous masking voice signal without a basis of a voice pickup signal. As shown in the voice signal example 120-1, the other people 9 are familiar with the masking voice signal since the masking voice signal is reproduced with a constant volume and a constant band.

The voice signal example 120-2 represents a waveform when the signal processing unit 12 generates a masking voice signal during the utterance of the user 8, that is, only in a time section in which a user's voice is included in a voice pickup signal. As shown in the voice signal example 120-2, the other people 9 can be prevented from becoming familiar with the masking voice signal since the reproduction of the masking voice signal is interrupted in a time section in which the user 8 does not speak. Accordingly, a specific example of the configuration of the signal processing unit 12 configured to generate a masking voice signal only in a time section in which a user's voice is included in a voice pickup signal will be described with reference to FIGS. 5 and 6.

Figure 5:
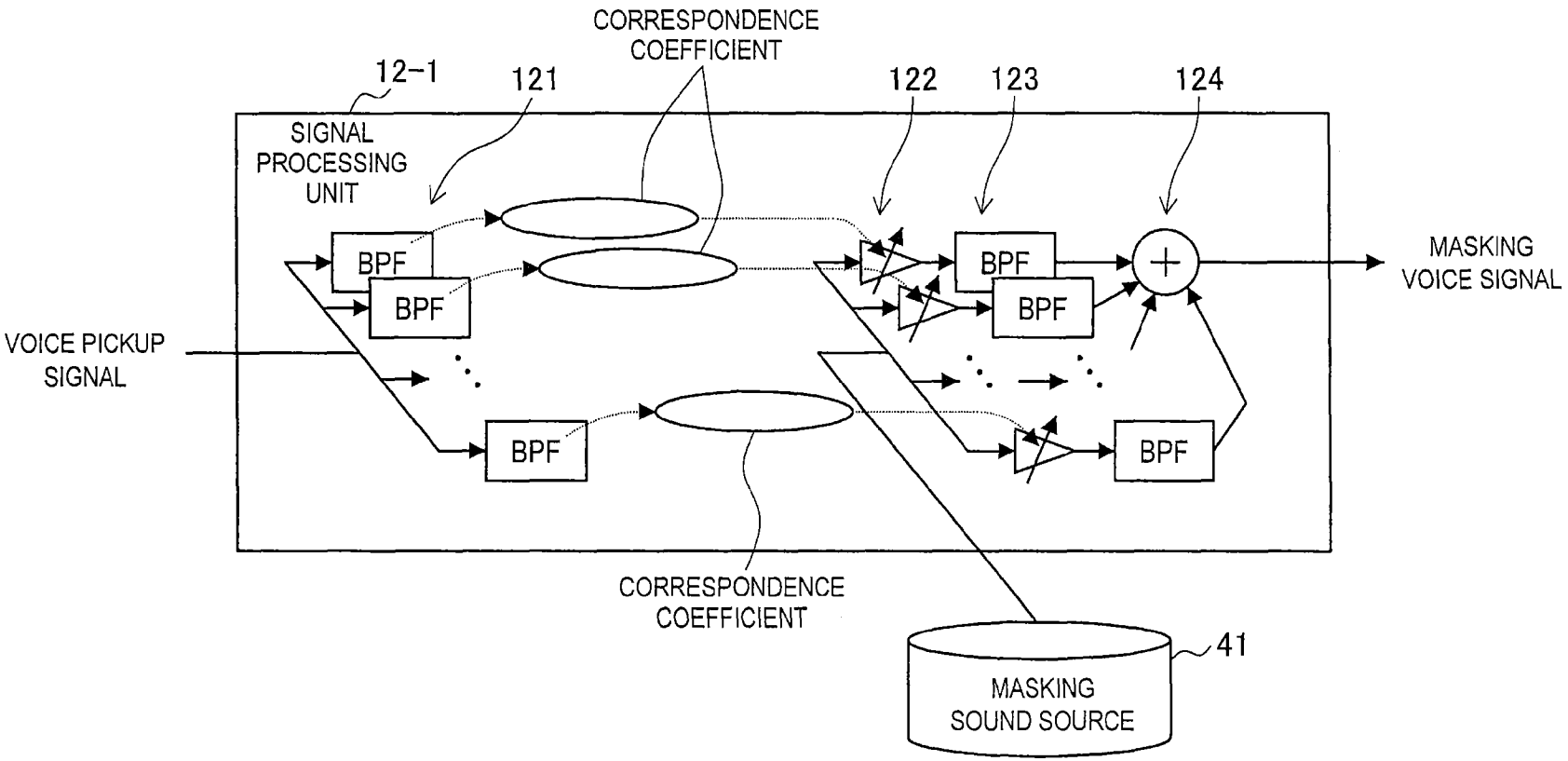
FIG. 5 is an explanatory diagram illustrating an example of the configuration of the signal processing unit according to the first embodiment.

FIG. 5 is an explanatory diagram illustrating an example of the configuration of the signal processing unit 12 according to the first embodiment. As illustrated in FIG. 5, a signal processing unit 12-1 includes an analysis band pass filter (BPF) group 121, a variable gain block group 122, a synthesis BPF group 123, and an adder 124. The signal processing unit 12-1 has a function of analyzing an utterance voice using a BPF bank and generating a masking voice signal according to a data amount of each frequency component constituting a user's voice. Hereinafter, each constituent element of the signal processing unit 12-1 will be described in detail.

Analysis BPF Group 121

The analysis BPF group 121 is a filter bank completed from a plurality of BPF arrays. The analysis BPF group 121 calculates a correspondence coefficient based on a data amount such as amplitude for each frequency band component constituting a user's voice. For example, the analysis BPF included in the analysis BPF group 121 passes through each predetermined frequency band and calculates the correspondence coefficient by a sum of squares of data at a predetermined time width. Here, the correspondence coefficient indicates a component ratio of each frequency band component constituting a user's voice and a distribution ratio of each frequency band component of the masking voice signal generated by the signal processing unit 12-1. The analysis BPF included in the analysis BPF group 121 outputs the calculated correspondence coefficient to a corresponding variable gain block included in the variable gain block group 122.

Variable Gain Block Group 122

The variable gain block group 122 has a function of amplifying a voice signal acquired from the masking sound source 41. The variable gain block included in the variable gain block group 122 amplifies the voice signal acquired from the masking sound source 41 based on the correspondence coefficient output from the corresponding analysis BPF and outputs the amplified voice signal to a corresponding synthesis BPF included in the synthesis BPF group 123.

Synthesis BPF Group 123

The synthesis BPF group 123 is a filter bank completed from a plurality of BPF arrays. The synthesis BPF included in the synthesis BPF group 123 passes through the same frequency band component as the corresponding analysis BPF from the voice signal output from the corresponding variable gain block and generates a synthesis voice signal. The synthesis BPF group 123 outputs the generated voice signal to the adder 124.

Adder 124

The adder 124 generates a masking voice signal by synthesizing the voice signals output from the synthesis BPF group 123.

Thus, a correspondence relation between a response amount of each BPF included in the analysis BPF group 121 and a variable gain amount of each variable gain block included in the variable gain block group 122 is regulated by the correspondence coefficient. Accordingly, the signal processing unit 12-1 can generate the masking voice signal according to the data amount of each frequency band component of the voice pickup signal. That is, the signal processing unit 12-1 can generate the masking voice signal only in the time section in which the user's voice is included in the voice pickup signal. Also, the signal processing unit 12-1 can generate the masking voice signal which has the same distribution ratio of the frequency band component as the user's voice, that is, is similar to the utterance voice of the user 8. For this reason, the masking voice signal generated by the signal processing unit 12-1 can cause the other people 9 to mistake the masking voice signal for the utterance of the user 8, and thus the utterance of the user 8 can be masked more strongly.

The example of the configuration of the signal processing unit 12 generating the masking voice signal using the BPF bank analysis has been described above. Next, another example of the configuration of the signal processing unit 12 will be described with reference to FIG. 6.

Figure 6:
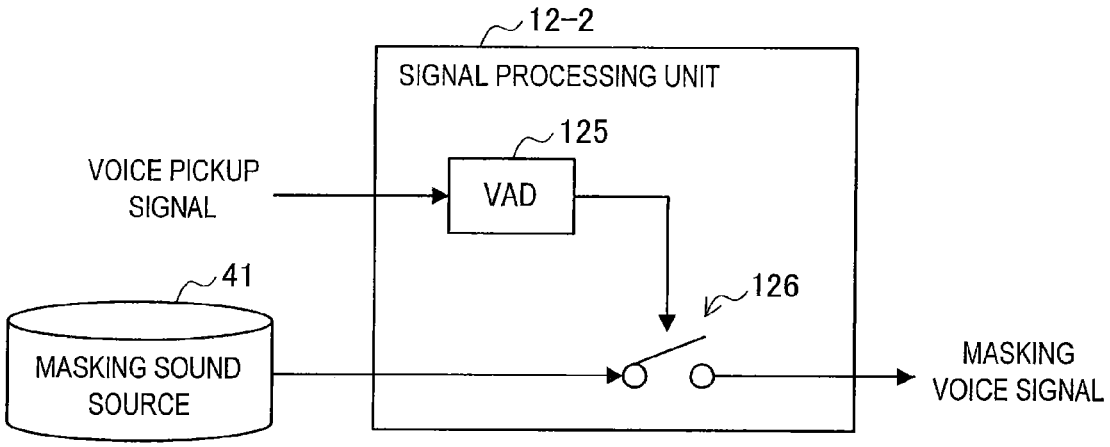
FIG. 6 is an explanatory diagram illustrating an example of the configuration of the signal processing unit according to the first embodiment.

FIG. 6 is an explanatory diagram illustrating an example of the configuration of the signal processing unit 12 according to the first embodiment. As illustrated in FIG. 6, a signal processing unit 12-2 includes voice activity detection (VAD) 125 and a switch 126. Each constituent element of the signal processing unit 12-2 will be described in detail.

VAD 125

The VAD 125 has a function of detecting a voice section in which a voice is uttered and a noise section other than the voice section from the input voice pickup signal. The VAD 125 controls the switch 126 according to whether a time section is the voice section or the noise section.

Switch 126

The switch 126 passes through or does not pass through the voice signal acquired from the masking sound source 41 under the control of the VAD 125 and outputs the voice signal as a masking voice signal. More specifically, the switch 126 passes through a voice signal acquired from the masking sound source 41 in a time section corresponding to the voice section of the voice pickup signal and does not pass through the voice signal in a time section corresponding to the noise section.

Thus, the signal processing unit 12-2 can generate a masking voice signal only in the time section in which the user's voice is included in the voice pickup signal by controlling the pass/non-pass of the voice signal acquired from the masking sound source 41 according to whether a time section is the voice section or the noise section.

The example of the configuration of the signal processing unit 12 generating the masking voice signal based on the method of the VAD has been described.

(Supplement)

The smartphone 1-1 may include an analog-to-digital converter (ADC) or a digital-to-analog converter (DAC). The ADC is an electronic circuit that converts an analog signal into a digital signal and the DAC is an electronic circuit that converts a digital signal into an analog signal. For example, the ADC may be installed in the rear stage of the mic amplifier 21. Also, the DAC may be installed in the front stage of the power amplifier 22 and the power amplifier 23.

The configuration of the smartphone 1-1 has been described above.

[2-1-2. Operation Process]

Figure 7:
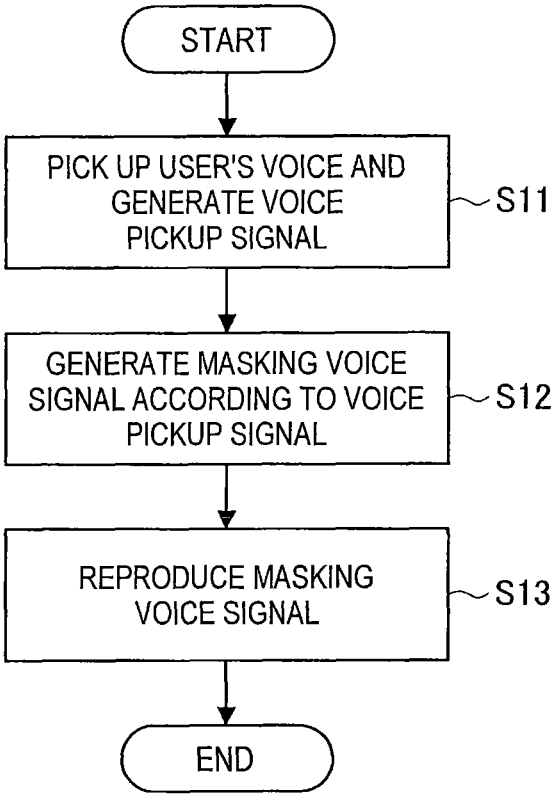
FIG. 7 is a flowchart illustrating an operation of the smartphone according to the first embodiment.

Next, an operation process of the smartphone 1-1 will be described with reference to FIG. 7. FIG. 7 is a flowchart illustrating the operation of the smartphone 1-1 according to the first embodiment. An operation according to other embodiments is the same as the operation of the smartphone 1-1. As illustrated in FIG. 7, the mic 3 first picks up a user's voice and generates a voice pickup signal in step S11.

Subsequently, in step S12, the signal processing unit 12 generates a masking voice signal according to the voice pickup signal generated by the mic 3. More specifically, the signal processing unit 12 generates a masking voice signal masking the user's voice according to the BPF bank analysis or the method of the VAD, as described above with reference to FIGS. 5 and 6.

Then, in step S13, the masking speaker 4 reproduces the masking voice signal generated by the signal processing unit 12. The smartphone 1-1 performs a telephone call by the mouthpiece unit 31 and the earpiece unit 32 or an operation based on the control information recognized from a voice by the control unit 11, while reproducing the masking voice signal.

The first embodiment has been described above. Next, a modification example of the first embodiment will be described.

[2-1-3. First Modification Example]

In the modification example, the telephone speaker 2 reproduces a masking voice signal along with a voice of a telephone call partner. Hereinafter, a smartphone 1-2 according to the modification example will be described with reference to FIG. 8.

Figure 8:
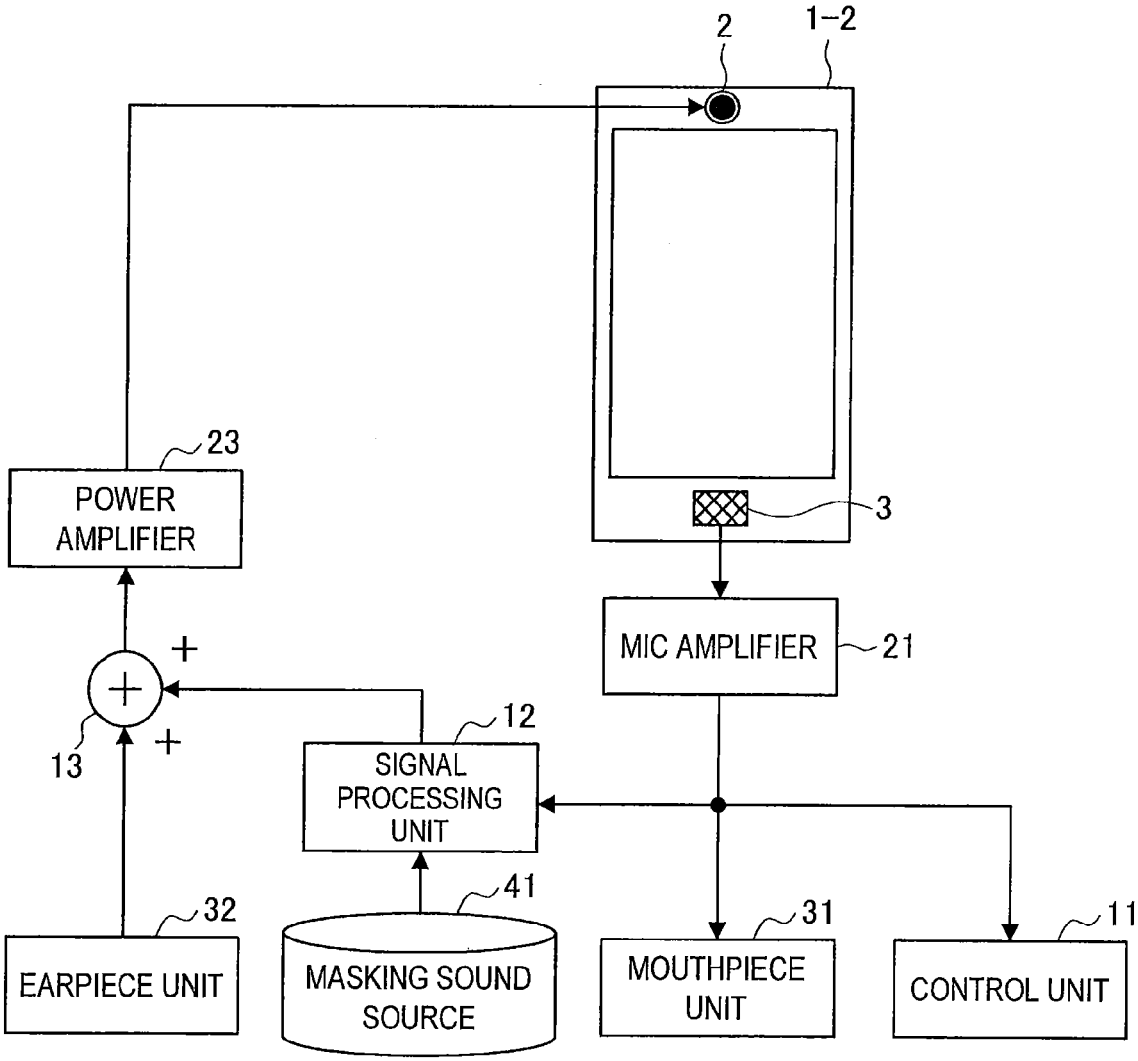
FIG. 8 is a block diagram illustrating the configuration of a smartphone according to a first modification example.

FIG. 8 is a block diagram illustrating the configuration of the smartphone 1-2 according to a first modification example. Each block illustrated in FIG. 8 is included in the smartphone 1-2. As illustrated in FIG. 8, the smartphone 1-2 according to the modification example has a configuration in which the masking speaker 4 and the power amplifier 22 are excluded from the smartphone 1-1 described above with reference to FIG. 3 according to the first embodiment and an adder 13 is added.

A masking voice signal generated by the signal processing unit 12 is output to the adder 13. The adder 13 has a function of synthesizing input signals and synthesizes the masking voice signal output from the signal processing unit 12 with an audio signal of the telephone partner output from the earpiece unit 32. The masking voice signal and the audio signal of the telephone partner synthesized by the adder 13 are amplified by the power amplifier 23 and are output by the telephone speaker 2. That is, the telephone speaker 2 reproduces the voice of the telephone call partner and the masking voice signal.

The smartphone 1-2 according to the modification example can reproduce the masking voice signal and mask the user's voice without using a plurality of speakers by using the telephone speaker 2 as the masking speaker 4. Also, in the modification example, the user 8 is assumed to use the smartphone 1-2 without holding the telephone speaker 2 to his or her ear in a hands-free telephone way or a voice recognition input way. The user 8 can talk loudly compared to the first embodiment in which the user uses the smartphone, holding the ear to the telephone speaker 2, that is, with the lip approaching the mic 3. Accordingly, the power amplifier 23 amplifies the masking voice signal more strongly compared to the first embodiment.

The first modification example has been described above.

<2-2. Second Embodiment>

In an embodiment herein, when a masking voice signal reproduced by the masking speaker 4 is picked up by the mic 3, a masking voice signal component is removed electronically from the voice pickup signal. The masking voice signal reproduced by the masking speaker 4 may be picked up by the mic 3 according to a position relation between the mic 3 and the masking speaker 4, the directions thereof, a reproduction volume, a voice pickup sensitivity, or the like, and thus may interrupt with a telephone call or voice recognition. From this viewpoint, in the embodiment, a high-quality telephone call or voice recognition for which noise is reduced can be realized by removing the masking voice signal component from the voice pickup signal. Hereinafter, a smartphone 1-3 according to the embodiment will be described with reference to FIG. 9.

Figure 9:
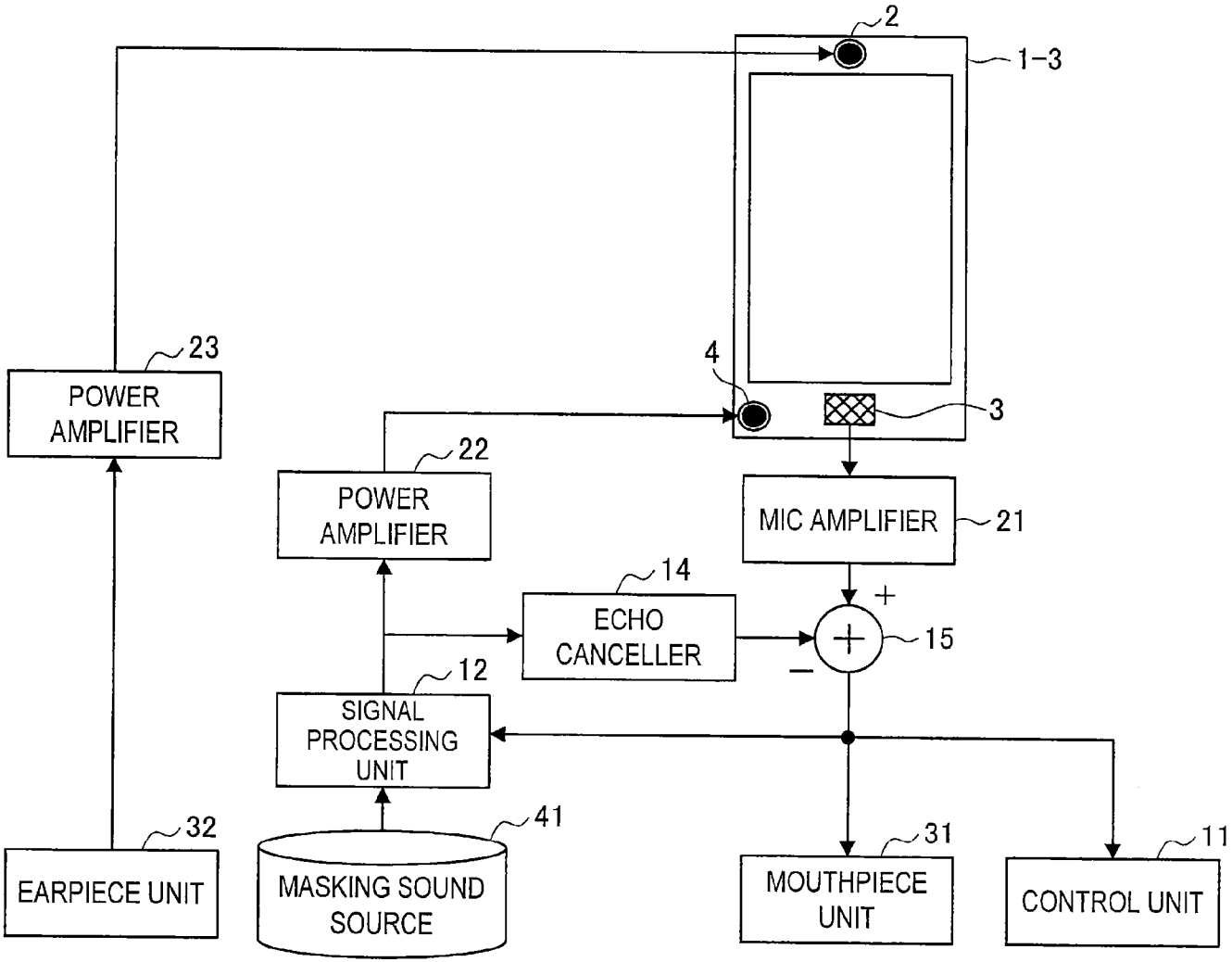
FIG. 9 is a block diagram illustrating the configuration of a smartphone according to a second embodiment.

FIG. 9 is a block diagram illustrating the configuration of the smartphone 1-3 according to a second embodiment. Each block illustrated in FIG. 9 is included in the smartphone 1-3. As illustrated in FIG. 9, the smartphone 1-3 according to the embodiment has a configuration in which an echo canceller 14 and an adder 15 are added to the smartphone 1-1 described above with reference to FIG. 3 in the first embodiment. Hereinafter, functions of the echo canceller 14 and the adder 15 will be described.

(Echo Canceller 14)

The echo canceller 14 has a function of a removal unit removing a masking voice signal from a voice pickup signal when the masking voice signal reproduced from the masking speaker 4 is picked up by the mic 3. Also, the echo canceller 14 and the adder 15 to be described below may be understood as functioning as a removal unit.

The echo canceller 14 generates a masking voice signal included in the voice pickup signal based on a specific transfer function and the masking voice signal generated by the signal processing unit 12. The echo canceller 14 estimates the transfer function of a space between the mic 3 and the masking speaker 4 based on the masking voice signal generated by the signal processing unit 12 and the characteristics of the mic 3 and the masking speaker 4. The echo canceller 14 may update the transfer function frequently according to a positional relation between the smartphone 1-3 and the user 8. Also, the echo canceller 14 may be realized as a digital filter. The transfer function can also be understood based on a correspondence relation between the masking voice signal generated by the signal processing unit 12 and the masking voice signal picked up by the mic 3.

The echo canceller 14 outputs the masking voice signal included in the generated voice pickup signal to the adder 15.

(Adder 15)

The adder 15 has a function of subtracting the masking voice signal generated by the echo canceller 14 from the voice pickup signal. For this reason, the masking voice signal reproduced by the masking speaker 4 and picked by the mic 3 is removed from the voice pickup signal. The adder 15 outputs the voice pickup signal from which the masking voice signal is removed to the control unit 11, the mouthpiece unit 31, and the signal processing unit 12.

Thus, in the embodiment, since the echo canceller 14 and the adder 15 can remove the masking voice signal component from the voice pickup signal, the high-quality telephone call or voice recognition for which noise is reduced can be realized. Also, since noise is also reduced from a received signal input to the signal processing unit 12, the signal processing unit 12 can generate the masking voice signal more suitable to the voice of the user 8.

The second embodiment has been described above.

<2-3. Third Embodiment>

[2-3-1. Basic Form]

In an embodiment herein, a plurality of speakers reproducing a masking voice signal are provided to perform cancellation on one another so that a masking voice signal component is removed from a voice pickup signal acoustically in a space. Hereinafter, a smartphone 1-4 according to the embodiment will be described with reference to FIG. 10. Hereinafter, an example in which two speakers reproducing a masking voice signal are provided will be described, but three or more speakers may be provided.

Figure 10:
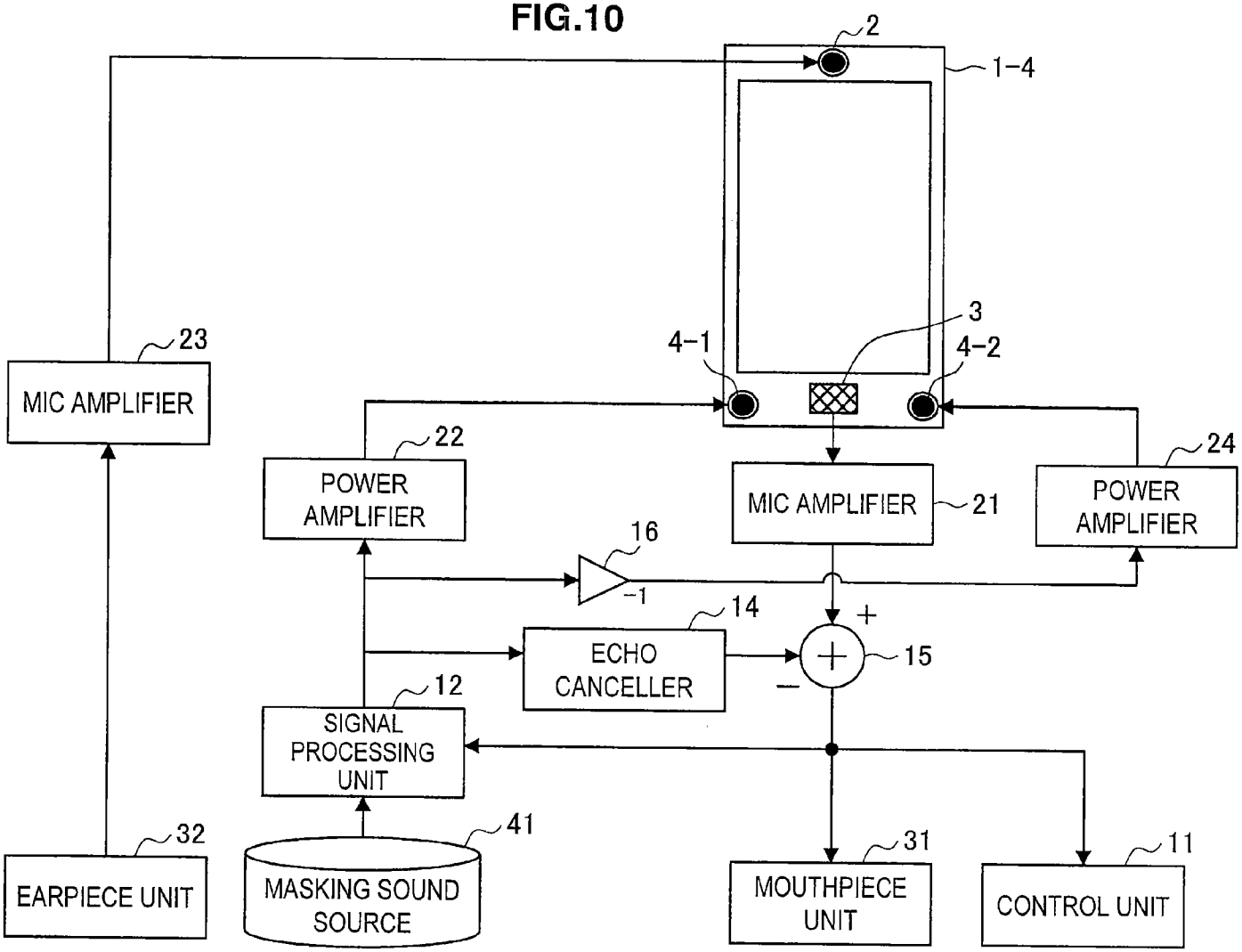
FIG. 10 is a block diagram illustrating the configuration of a smartphone according to a third embodiment.

FIG. 10 is a block diagram illustrating the configuration of the smartphone 1-4 according to a third embodiment. Each block illustrated in FIG. 10 is included in the smartphone 1-4. As illustrated in FIG. 10, the smartphone 1-4 according to the embodiment has a configuration in which a reverse-phase signal generation unit 16, a power amplifier 24, and a masking speaker 4-2 are added to the smartphone 1-2 described above with reference to FIG. 9 according to the second embodiment. The masking speaker 4 according to the second embodiment is referred to as a masking speaker 4-1 of the embodiment. Hereinafter, functions of the reverse-phase signal generation unit 16, the power amplifier 24, and the masking speaker 4-2 will be described.

(Reverse-Phase Signal Generation Unit 16)

The reverse-phase signal generation unit 16 has a function of generating a reverse-phase signal of the masking voice signal output from the signal processing unit 12. The reverse-phase signal generation unit 16 outputs the generated reverse-phase signal to the power amplifier 24.

(Power Amplifier 24)

The power amplifier 24 has a function of amplifying the reverse-phase signal output from the reverse-phase signal generation unit 16. The power amplifier 24 may amplify the signal to the same degree as the power amplifier 22. The power amplifier 24 outputs the amplified reverse-phase signal to the masking speaker 4-2.

(Masking Speaker 4-2)

The masking speaker 4-2 is an output device (second speaker) that reproduces the reverse-phase signal of the masking voice signal. Specifically, the masking speaker 4-2 reproduces the reverse-phase signal output from the power amplifier 24 simultaneously with the reproduction of the masking voice signal by the masking speaker 4-1. The masking speaker 4-2 is installed such that the masking voice signal reproduced from the masking speaker 4-1 and the reverse-phase signal reproduced from the masking speaker 4-2 are cancelled in a space in which the mic 3 picks up a voice. The masking speaker 4-2 has the same speaker characteristics as the masking speaker 4-1. As illustrated in FIG. 10, the masking speakers 4-2 and 4-1 are installed at geometrically symmetric positions, centering on the position of the mic 3.

The masking voice signal reproduced from the masking speaker 4-1 and the reverse-phase signal reproduced from the masking speaker 4-2 are cancelled in a clashing area. Such an area is also referred to as a cancellation area below. The cancellation area in the smartphone 1-4 will be described with reference to FIGS. 11(A) and 11(B).

Figure 11B:
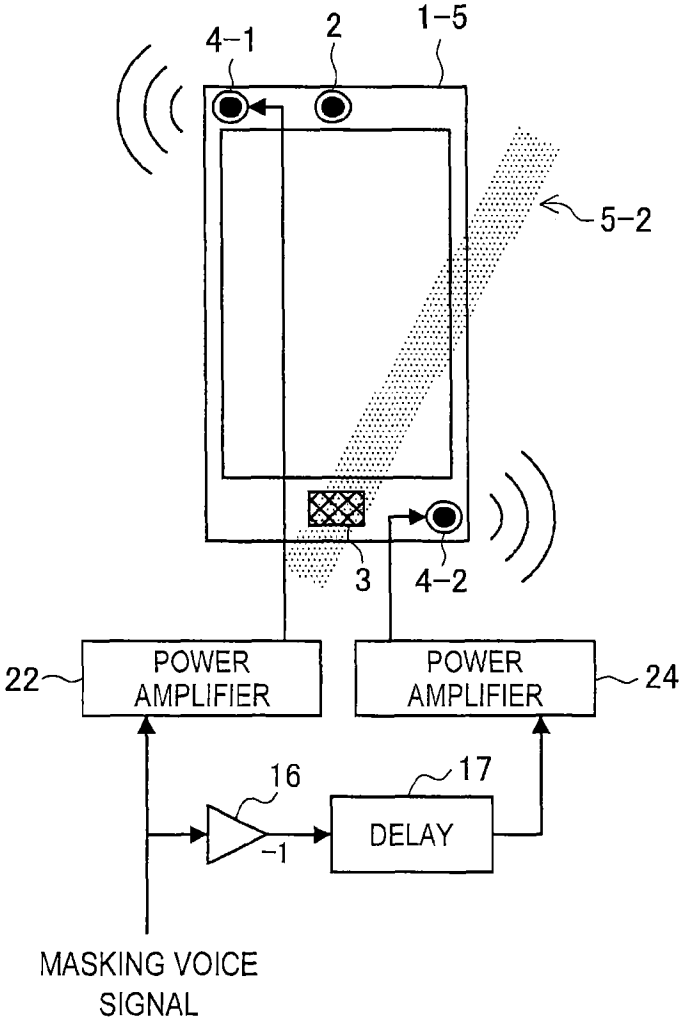
FIGS. 11(A) and 11(B) are explanatory diagrams illustrating cancellation areas in the smartphone according to the third embodiment.
Figure 11A:
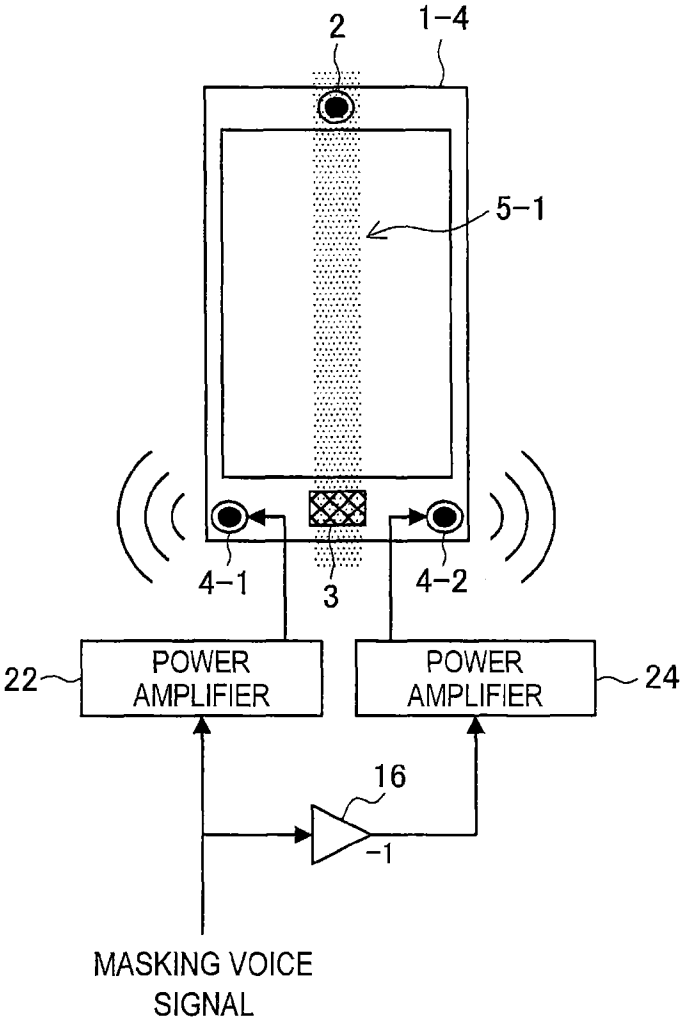

FIGS. 11(A) and 11(B) are explanatory diagrams illustrating cancellation areas according to the third embodiment. Each block illustrated in FIG. 11(A) is included in the smartphone 1-4. As illustrated in FIG. 11(A), a cancellation area 5-1 in the smartphone 1-4 is formed substantially in the middle region of the masking speakers 4-1 and 4-2 since the masking voice signal and the reverse-phase signal are simultaneously reproduced. Since the cancellation area 5-1 covers the mic 3, the masking voice signal is cancelled in the space in which the mic 3 picks up a voice. In this way, the smartphone 1-4 can remove the masking voice signal component from the voice pickup signal acoustically in a space. Also, the cancellation area 5-1 is located in the space in which the mic 3 picks up a voice, that is, at the lips of the user 8, and thus the user 8 can speak without being interrupted by the masking voice signal.

In general, an adverse effect of the reverse-phase signal is higher at a lower band frequency. For this reason, as the masking voice signal has a low region, the masking voice signal and the reverse-phase signal are cancelled more strongly, and thus the mic 3 can pick up the voice of the user 8 more clearly. An example of the masking voice signal with the low band includes a voice signal in which a vowel is a main component. Also, since the masking voice signal with the low band is removed by the masking speaker 4-2 acoustically in a space, the echo canceller 14 may electrically remove the masking voice signal particularly in intermediate and high regions. The smartphone 1-4 can remove the masking voice signal in the gamut by combining the masking speaker 4-2 and the echo canceller 14.

The third embodiment has been described above. Next, modification examples of the third embodiment will be described.

[2-3-2. Second Modification Example]

In a modification example herein, the masking speaker 4-2 reproduces a delayed reverse-phase signal so that a cancellation area is formed in an area other than the middle region of the masking speaker 4-1 and the masking speaker 4-2. Hereinafter, a smartphone 1-5 according to the embodiment will be described with reference to FIG. 11(B).

In the smartphone 1-5 according to the modification example, as illustrated in FIG. 11(B), the masking speakers 4-1 and 4-2 are not installed at geometrically symmetric positions centering on the position of the mic 3. The smartphone 1-5 has the same internal configuration as the smartphone 1-4 described above with reference to FIG. 10. However, the smartphone 1-5 further includes a delay 17, as illustrated in FIG. 11(B). Hereinafter, a function of the delay 17 will be described.

(Delay 17)

The delay 17 has a function of delaying and outputting an input voice signal. In the modification example, the delay 17 functions as a delay unit that delays the reverse-phase signal generated by the reverse-phase signal generation unit 16. More specifically, the delay 17 delays the reverse-phase signal so that the masking voice signal reproduced from the masking speaker 4-1 and the reverse-phase signal reproduced from the masking speaker 4-2 are cancelled in the space in which the mic 3 picks up the voice. The delay 17 outputs the delayed reverse-phase signal to the power amplifier 24. Also, the delay 17 may have a specific filter format.

The reverse-phase signal delayed by the delay 17 is amplified by the power amplifier 24 and is reproduced by the masking speaker 4-2. Then, the reverse-phase signal reproduced from the masking speaker 4-2 and the masking voice signal output from the masking speaker 4-1 are cancelled at a position closer to the masking speaker 4-2 to the degree that the reverse-phase signal is delayed by the delay 17.

That is, as illustrated in FIG. 11(B), a cancellation area 5-2 is formed at a position closer to the masking speaker 4-2 and covers the mic 3 installed at the position closer to the masking speaker 4-2 than the masking speaker 4-1.

For this reason, the smartphone 1-5 can remove the masking voice signal component from the voice pickup signal even when the masking speakers 4-1 and 4-2 are not installed at the geometrically symmetric positions centering on the position of the mic 3. Also, the masking speakers 4-2 and 4-1 may have different speaker characteristics. Thus, in the smartphone 1-5, the delay effect obtained from the delay 17 enables alleviation of the restrictions related to the speaker characteristics and the position at which the masking speaker 4-2 is installed. For this reason, in the smartphone 1-5, the sizes, the positional relation, the overall design, and the like of the masking speakers 4-2 and 4-1 can be realized freely.

The second modification example has been described above. Next, another modification example of the third embodiment will be described.

[2-3-3. Third Modification Example]

In a modification example here, a signal processing device according to an embodiment of the present disclosure is realized by a head set 6. Hereinafter, a head set 6 according to the modification example will be described with reference to FIG. 12.

Figure 12:
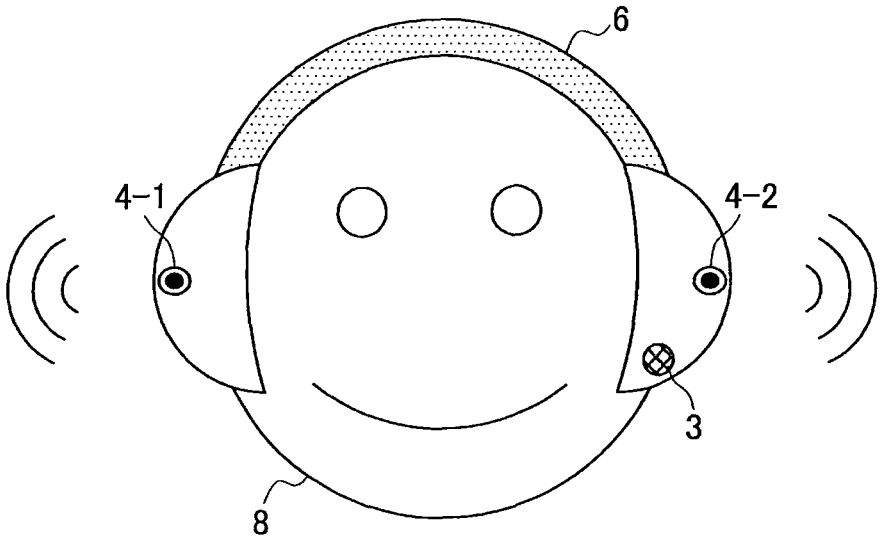
FIG. 12 is an explanatory diagram illustrating a head set according to a third modification example.

FIG. 12 is an explanatory diagram illustrating the head set 6 according to a third modification example. As illustrated in FIG. 12, the head set 6 includes a masking speaker 4-1, a masking speaker 4-2, and a mic 3 and is mounted on a head portion of the user 8. The head set 6 has the same configuration as the smartphone 1-5 described above with reference to FIG. 11(B). As illustrated in FIG. 12, the mic 3 is installed at a position closer to the masking speaker 4-2. Therefore, since the head set 6 reproduces a reverse-phase signal delayed by the delay 17 from the masking speaker 4-2, the mic 3 is covered with a cancellation area. Thus, in the head set 6, the masking voice signal component can be removed from the sound pickup signal acoustically in a space.

The third modification example has been described above.

<3. Conclusion>

As described above, since the smartphone 1 according to the embodiments of the present disclosure generates and reproduces a masking voice signal according to a user's voice, the utterance content of the user 8 can be prevented from being heard. More specifically, since the smartphone 1 generates and reproduces the masking voice signal to confuse or distract the other people 9, the utterance of the user 8 can be embedded in the masking voice signal, and thus the utterance content can be hindered from being heard. Also, the smartphone 1 reproduces the masking voice signal only in a time section in which the user's voice is included in the sound pickup signal so that the other people 9 can be prevented from becoming familiar with the masking voice signal.

Since the smartphone 1 electrically removes the masking voice signal component from the sound pickup signal, the high-quality telephone call or voice recognition for which noise is reduced can be realized. Also, since the smartphone 1 includes the plurality of speakers reproducing the masking voice signals to realize the mutual cancellation, the masking voice signal component can be removed from the voice pickup signal acoustically in a space.

The preferred embodiments of the present technology have been described in detail with reference to the appended drawings, but the technical range of the present technology is not limited to the examples. It should be understood by those skilled in the art that various modifications, combinations, sub-combinations and alterations may occur depending on design requirements and other factors insofar as they are within the scope of the appended claims or the equivalents thereof.

For example, in the foregoing embodiments, the examples in which the masking voice signal is generated and reproduced when the user 8 performs a telephone call or voice recognition input have been described, but embodiments of the present disclosure are not limited to the examples. For example, the embodiments of the present disclosure may be applied to a noise device that prevents other people from hearing sleep talking, soliloquy, or complaint of the user 8.

A computer program can also be generated to cause hardware such as a CPU, a ROM, and a RAM included in an information processing device to perform the same function of each configuration of the above-described smartphone 1. Also, a storage medium storing the computer program is provided.

Additionally, the present technology may also be configured as below.

(1) A signal processing device including:

a voice pickup unit that picks up a user's voice and generates an audio signal;

a signal processing unit that generates a masking voice signal for masking the user's voice according to the audio signal; and a first speaker that reproduces the masking voice signal.

(2) The signal processing device according to (1), wherein the signal processing unit generates the masking voice signal only in a time section in which the user's voice is included in the audio signal.

(3) The signal processing device according to (1) or (2), further including:

a removal unit, wherein the removal unit removes the masking voice signal from the audio signal generated by the voice pickup unit based on a specific transfer function and the masking voice signal generated by the signal processing unit when the voice pickup unit picks up the masking voice signal reproduced from the first speaker along with the user's voice and generates the audio signal.

(4) The signal processing device according to any one of (1) to (3), further including:

a second speaker that reproduces a reverse-phase signal of the masking voice signal, wherein the second speaker is installed in a manner that the masking voice signal reproduced from the first speaker and the reverse-phase signal reproduced from the second speaker are cancelled in a space in which the voice pickup unit picks up the user's voice.

(5) The signal processing device according to (4), further including:

a delay unit that delays the reverse-phase signal, wherein the second speaker reproduces the reverse-phase signal delayed by the delay unit.

(6) The signal processing device according to any one of (1) to (5), wherein the signal processing unit generates the masking voice signal according to a data amount of a frequency component constituting the user's voice.

(7) The signal processing device according to any one of (1) to (6), wherein the masking voice signal is band noise of a voice band.

(8) The signal processing device according to any one of (1) to (6), wherein the masking voice signal is a voice signal in which a vowel is a main component.

(9) The signal processing device according to any one of (1) to (8), further including:

a recording unit that records the user's voice picked up by the voice pickup unit, wherein the signal processing unit generates the masking voice signal based on the user's voice recorded in the recording unit.

(10) The signal processing device according to any one of (1) to (9), further including:

a language recognition unit that recognizes a language of the user's voice picked up by the voice pickup unit, wherein the signal processing unit generates the masking voice signal according to the language recognized by the language recognition unit.

(11) The signal processing device according to (10), wherein the signal processing unit generates the masking voice signal based on a language identical with the language recognized by the language recognition unit.

(12) The signal processing device according to (10), wherein the signal processing unit generates the masking voice signal based on a language different from the language recognized by the language recognition unit.

(13) The signal processing device according to any one of (1) to (12), further including:

a communication unit that transmits the audio signal to an outside and receives an audio signal from the outside.

(14) The signal processing device according to any one of (1) to (13), further including:

a control information recognition unit that recognizes control information from the audio signal; and a control unit that controls the signal processing device based on the control information recognized by the control information recognition unit.

(15) A signal processing method including:

picking up a user's voice and generating an audio signal; generating a masking voice signal for masking the user's voice according to the audio signal; and reproducing the masking voice signal.

(16) A non-transitory computer-readable storage medium having a program stored therein, the program causing a computer to execute:

picking up a user's voice and generating an audio signal;

generating a masking voice signal for masking the user's voice according to the audio signal; and reproducing the masking voice signal.

What is claimed is:

1. A signal processing device comprising:

a voice pickup unit that picks up a user's voice and generates an audio signal;

a signal processing unit that generates a masking voice signal for masking the user's voice according to the audio signal;

a first speaker that reproduces the masking voice signal; and a second speaker that reproduces a reverse-phase signal of the masking voice signal, wherein the second speaker is installed in a manner that the masking voice signal reproduced from the first speaker and the reverse-phase signal reproduced from the second speaker are cancelled in a space in which the voice pickup unit picks up the user's voice.

2. The signal processing device according to claim 1, wherein the signal processing unit generates the masking voice signal only in a time section in which the user's voice is included in the audio signal.

3. The signal processing device according to claim 1, further comprising:

a removal unit, wherein the removal unit removes the masking voice signal from the audio signal generated by the voice pickup unit based on a specific transfer function and the masking voice signal generated by the signal processing unit when the voice pickup unit picks up the masking voice signal reproduced from the first speaker along with the user's voice and generates the audio signal.

4. The signal processing device according to claim 1, further comprising:

a communication unit that transmits the audio signal to an outside and receives an audio signal from the outside.

5. The signal processing device according to claim 1, further comprising:

a delay unit that delays the reverse-phase signal, wherein the second speaker reproduces the reverse-phase signal delayed by the delay unit.

6. The signal processing device according to claim 1, wherein the signal processing unit generates the masking voice signal according to a data amount of a frequency component constituting the user's voice.

7. The signal processing device according to claim 1, wherein the masking voice signal is band noise of a voice band.

8. The signal processing device according to claim 1, wherein the masking voice signal is a voice signal in which a vowel is a main component.

9. The signal processing device according to claim 1, further comprising:

a recording unit that records the user's voice picked up by the voice pickup unit, wherein the signal processing unit generates the masking voice signal based on the user's voice recorded in the recording unit.

10. The signal processing device according to claim 1, further comprising:

a language recognition unit that recognizes a language of the user's voice picked up by the voice pickup unit, wherein the signal processing unit generates the masking voice signal according to the language recognized by the language recognition unit.

11. The signal processing device according to claim 10, wherein the signal processing unit generates the masking voice signal based on a language identical with the language recognized by the language recognition unit.

12. The signal processing device according to claim 10, wherein the signal processing unit generates the masking voice signal based on a language different from the language recognized by the language recognition unit.

13. The signal processing device according to claim 1, further comprising:

a control information recognition unit that recognizes control information from the audio signal; and a control unit that controls the signal processing device based on the control information recognized by the control information recognition unit.

14. A signal processing device comprising:

a voice pickup unit that picks up a user's voice and generates an audio signal;

a signal processing unit that generates a masking voice signal for masking the user's voice according to the audio signal;

a first speaker that reproduces the masking voice signal; and a removal unit, wherein the removal unit removes the masking voice signal from the audio signal generated by the voice pickup unit based on a specific transfer function and the masking voice signal generated by the signal processing unit when the voice pickup unit picks up the masking voice signal reproduced from the first speaker along with the user's voice and generates the audio signal.

15. A signal processing method comprising:

picking up a user's voice and generating an audio signal;

generating a masking voice signal for masking the user's voice according to the audio signal;

reproducing the masking voice signal; and reproducing a reverse-phase signal of the masking voice signal, wherein reproducing the reverse-phase signal of the masking voice signal is performed in a manner that the reproduced masking voice signal and the reproduced reverse-phase signal of the masking voice signal are cancelled in a space in which the user's voice is picked up for generating the audio signal.

16. A non-transitory computer-readable storage medium having stored thereon, a set of computer-executable instructions for causing a computer to perform a method comprising:

picking up a user's voice and generating an audio signal;

generating a masking voice signal for masking the user's voice according to the audio signal;

reproducing the masking voice signal; and reproducing a reverse-phase signal of the masking voice signal, wherein reproducing the reverse-phase signal of the masking voice signal is performed in a manner that the reproduced masking voice signal and the reproduced reverse-phase signal of the masking voice signal are cancelled in a space in which the user's voice is picked up for generating the audio signal.

* * * * *